US005243846A

United States Patent [19]

Davis et al.

[11] Patent Number: 5,243,846

[45] Date of Patent: Sep. 14, 1993

[54] CRIMPING APPARATUS WITH LOADING AND UNLOADING APPARATUS

[75] Inventors: Edward H. Davis; Gerald F. Klaes, both of Denver, Colo.

[73] Assignee: The Gates Rubber Company, Denver, Colo.

[21] Appl. No.: 417,373

[22] Filed: Oct. 5, 1989

Related U.S. Application Data

[62] Division of Ser. No. 145,445, Jan. 19, 1988, Pat. No. 4,885,928.

[51] Int. Cl.[5] ..... B21D 41/04; B25B 27/02

[52] U.S. Cl. ..... 72/402; 29/278; 29/280; 29/426.5; 29/525

[58] Field of Search ..... 72/402; 29/237, 278, 29/280, 434, 464, 468, 426.5, 525; 76/107 R, 4

[56] References Cited

U.S. PATENT DOCUMENTS

| | | | |
|---|---|---|---|
| 3,568,495 | 3/1971 | Duffield | 72/402 |
| 3,729,789 | 5/1973 | Otto | 29/426.5 |
| 4,250,607 | 2/1981 | Lillbacka | 72/402 |
| 4,266,336 | 5/1981 | Kasey | 29/426.5 |
| 4,535,522 | 8/1985 | Averill | 29/280 |
| 4,766,808 | 8/1988 | Schrock | 72/402 |

*Primary Examiner*—Daniel C. Crane

*Attorney, Agent, or Firm*—H. W. Oberg; C. H. Castleman, Jr.; J. L. Isaac

[57] ABSTRACT

A loading apparatus for slidably loading a plurality of circumjacent, radially arranged crimping members into the crimping member holders provided in the head of a crimping apparatus.

11 Claims, 7 Drawing Sheets 80
70
16
74
72
78
20
14
88
90
104
106
84
92

122
24
22
70
56
54
64
60
40
26
62
58
112
116
28
96
98
124
120
114
118
110
100
102
92
30
106
20
14
16

26
40
114
112
116
122
108
54
62
58
70
66
118
124
120
110
56
28
96
98
100
102
94
30
20
14
106
16

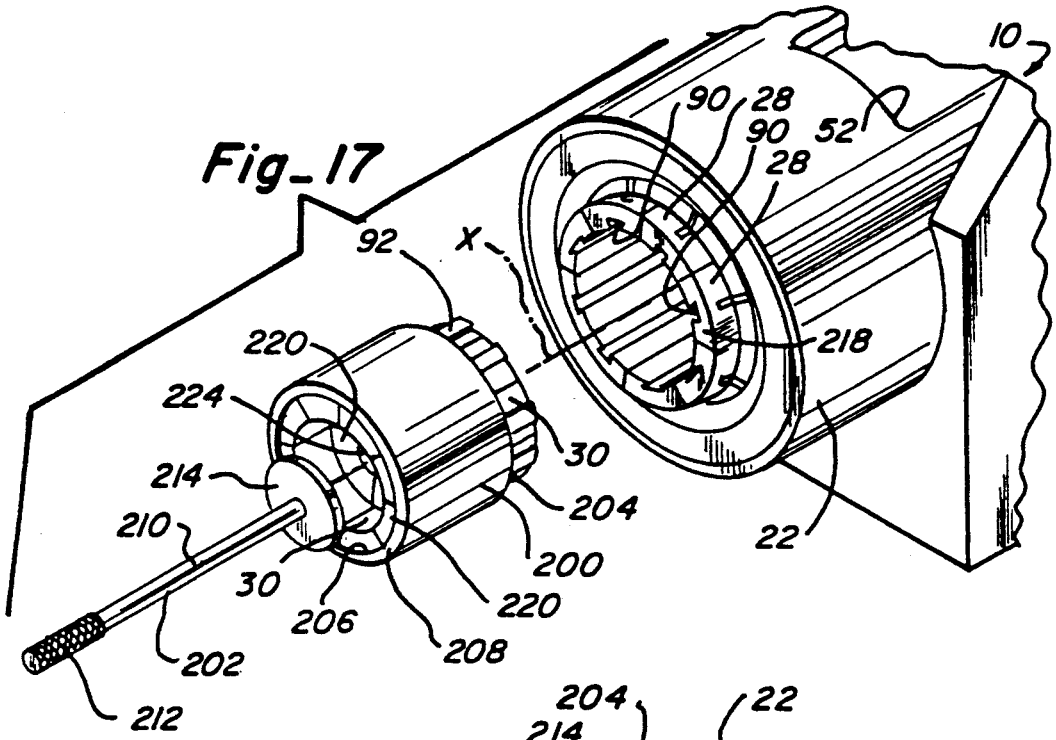
Fig_17
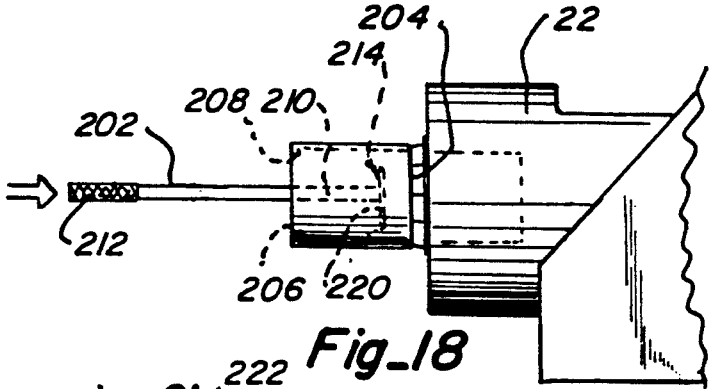
Fig_18
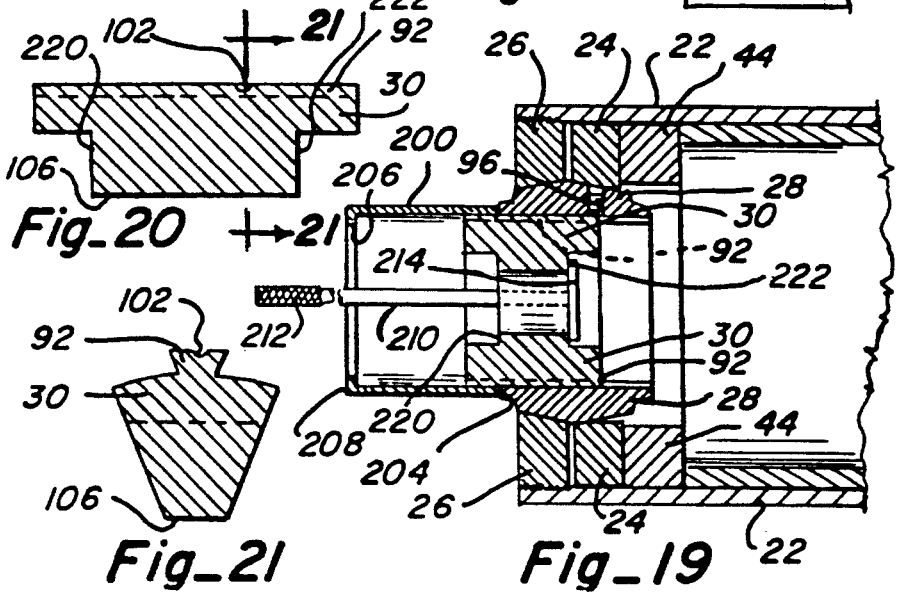
Fig_20
Fig_21
Fig_19

CRIMPING APPARATUS WITH LOADING AND UNLOADING APPARATUS

This is a division of application Ser. No. 07/145,445 filed Jan. 19, 1988, now U.S. Pat. No. 4,885,928, issued Dec. 12, 1989.

TECHNICAL FIELD

The invention relates generally to crimping methods and apparatus and, more particularly, to method and apparatus for crimping using a plurality of radially positioned and moveable members.

BACKGROUND ART

A problem associated with crimping machines is the difficulty of changing the crimping members when it is desired to crimp hose of a different diameter. One method used today involves connecting individual crimping members or die fingers to a radially slotted retainer plate or die cage which is then inserted into the crimping machine. This method has several drawbacks including extensive machining of the retaining plates and the general requirement that a different retaining plate is needed for each different die set up. Another method of loading dies into a crimping device involves attaching each crimping member or die finger individually to a die shoe. This method is not only time consuming but difficult due to the general lack of clearance in the crimping head.

An object of the present invention is to provide an apparatus for slidably loading a plurality of crimping members together into the crimping head of a crimping apparatus.

This, as well as other objectives, will become apparent from a reading of this disclosure and claims and an inspection of the accompanying drawings appended hereto.

SUMMARY OF THE INVENTION

The present invention provides improved apparatus and methods for crimping members, generally tubular members, together. The crimping apparatus includes a pair of first and second axially spaced, coaxial rings, at least one of which is axially moveable by an actuating means of the crimper toward and away from the other ring. Each ring is provided with a single pair of force reactive adjoining steep and shallow concave frustoconical surfaces and the rings are oriented so that their force reactive surfaces face each other. In addition, the rings' steep surfaces are inclined at a greater angle from the ring axis than the shallow surfaces.

The crimping apparatus also includes a plurality of circumjacently spaced and radially arranged crimping members which are positioned intermediate the rings. Each crimping member has a first and second pair of steep and shallow force reactive convex frustoconical surfaces that slidably engage with the concave force reactive steep and shallow frustoconical surfaces of the first and second rings. As such, the engaging force reactive convex and concave frustoconical surfaces define means for radially moving the crimping members toward and away from the ring axis between an open position and a radially inward crimping position. The radial movement of the crimping members is in response to axial movement of at least one of the annular rings which is moved by the actuating means. The crimping members steep convex surfaces are also inclined at a greater angle from the ring axis than the crimping members shallow convex frustoconical surfaces.

The present invention provides loading apparatus for slidably loading a plurality of circumjacent, radially arranged crimping members into crimping member holders provided in the head of a crimping device, the holders being radially arranged about an axis of the crimping device. The loading apparatus includes a container for slidably receiving and holding the plurality of circumjacent, radially arranged crimping members. The container has an open top end through which the plurality of crimping members passes when being loaded into the crimping device. The container also has an open bottom end with restraining means attached thereto for preventing the plurality of crimping members from passing or falling through the container's bottom end. In addition, the loading apparatus includes a plunger having a stem-like handle and a push-pull means attached to an end of the handle. The push-pull means is sized and configured to pass through the container's bottom end to push the circumjacent, radially arranged crimping members out through the container's top end and slidably load the crimping members into the holders, i.e., when the top end of the container is located against the holders and axially aligned therewith.

The present invention includes providing a double angle, double ring crimping apparatus having a plurality of circumjacent, radially arranged crimping members positioned intermediate the rings. The crimping members are axially and radially moveable along the ring axis of the crimping apparatus between an open loading position and a closed crimping position. The axial and radial movement is in response to axial movement of at least one of the rings.

The present invention also provides a method of slidably loading a plurality of circumjacent, radially arranged crimping members into crimping member holders in the crimping head of a crimping apparatus, the holders being radially arranged about an axis of the crimping apparatus. The method includes the steps of containing the plurality of crimping members so that the crimping members are capable of being slidably loaded together into the holders. The method also includes axially aligning the plurality of contained crimping members with the axis of the crimping apparatus. The axially aligned crimping members are then positioned up against the holders and pushed axially towards the holders to slide the crimping members into the holders, thereby loading the crimping head with the crimping members.

Additional advantages of this invention will become apparent from the description which follows, taken in conjunction with the accompanying drawings.

BRIEF DESCRIPTION OF THE DRAWINGS

FIG. 17 is an exploded perspective view of the loading apparatus of the present invention axially aligned with the crimping head of the present invention.

FIG. 18 is a side view illustrating the crimping members being slidably loaded to the crimping head of FIG. 17 with the loading apparatus of the present invention.

FIG. 19 is a top cross-sectional view illustrating use of the loading apparatus of the present invention to remove crimping members from the crimping head illustrated in FIG. 17.

FIG. 20 is a side cross-sectional view of a crimping member or die finger which is contained by the loading apparatus of the present invention and which is capable of being slidably loaded into the crimping head of FIG. 17 and slidably removed therefrom by the loading apparatus of the present invention.

FIG. 21 is a cross-sectional view taken along the lines 21—21 of FIG. 20.

BEST MODE FOR CARRYING OUT THE INVENTION

Figure 6:
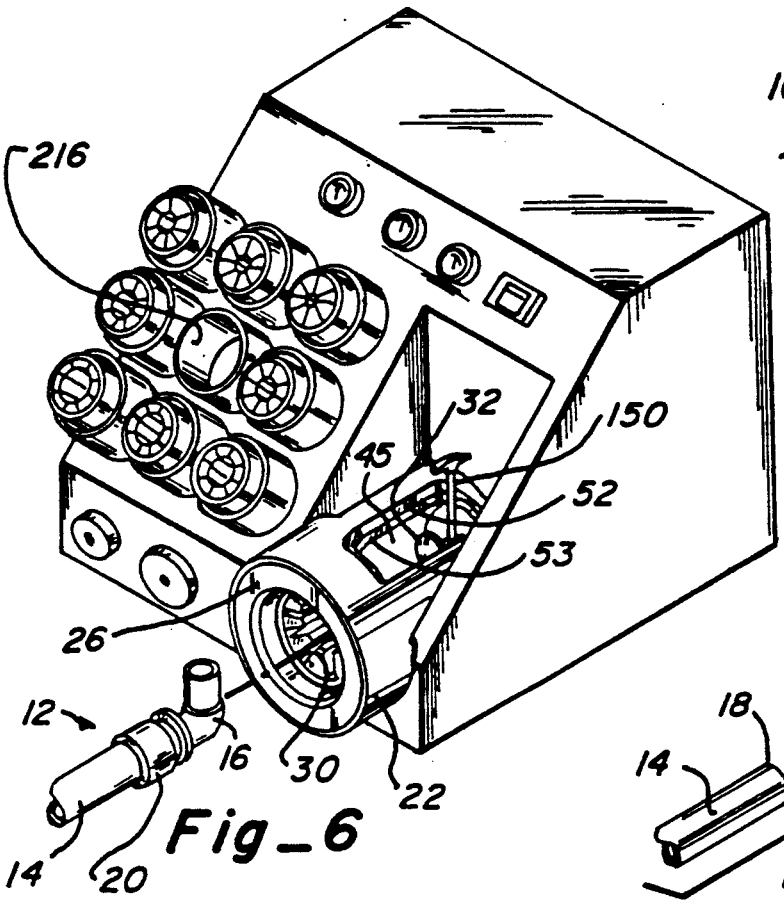
FIG. 6 is a perspective view illustrating a crimping apparatus of the present invention and a bent fitting assembly which is capable of being crimped by the crimping apparatus.
Figure 7:
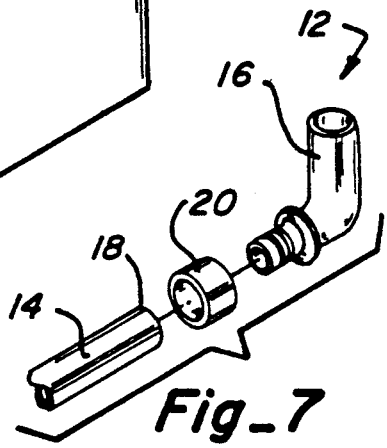
FIG. 7 is an exploded perspective view of the bent fitting assembly illustrated in FIG. 6.
Figure 8:
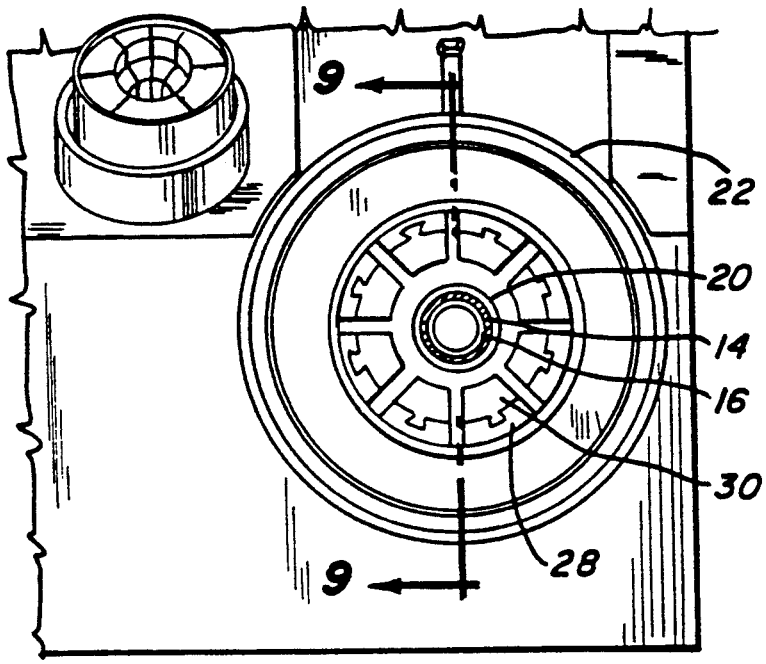
FIG. 8 is a partial broken away front view of the crimping apparatus illustrated in FIG. 6.

FIG. 6 illustrates a crimping device 10 of the present invention for securing or crimping the components of a flexible hose assembly 12 together. FIG. 7 is an exploded view of hose assembly 12 illustrating a flexible hose 14, a bent fitting 16 which is inserted into an end 18 of hose 14 and a ferrule 20 which is inserted over end 18 of hose 14. Ferrule 20 is crimped by device 10 to secure the bent fitting to the hose.

Figure 9:
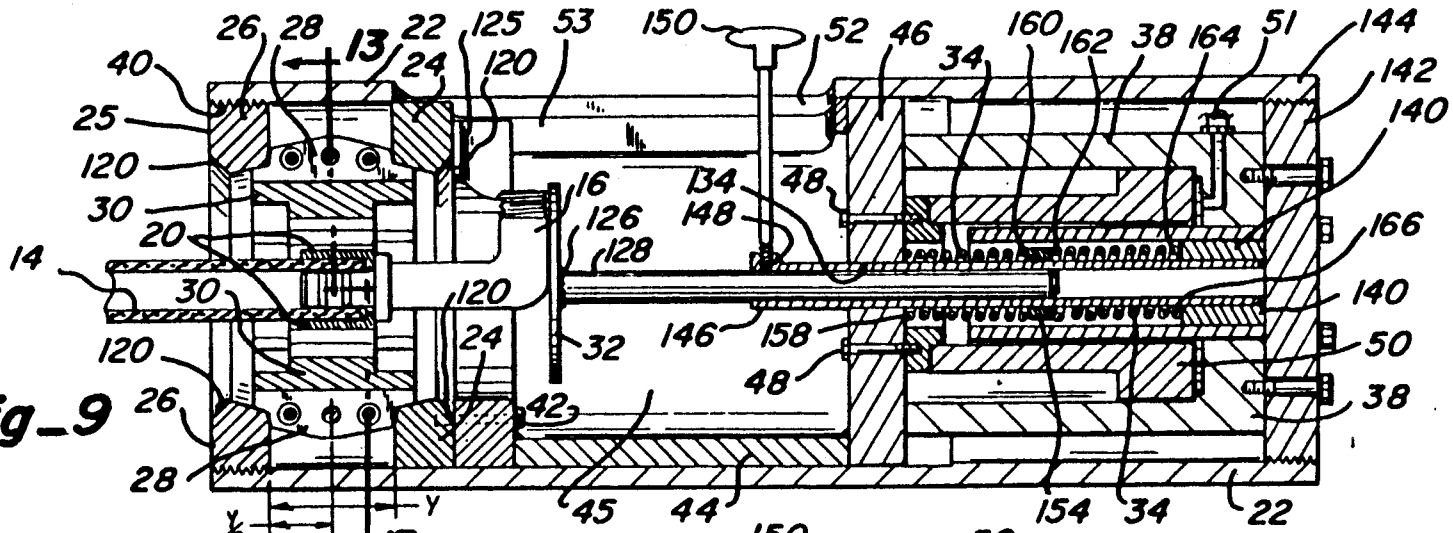
FIG. 9 is a cross-sectional view taken along the lines 9—9 of FIG. 8.
Figure 10:
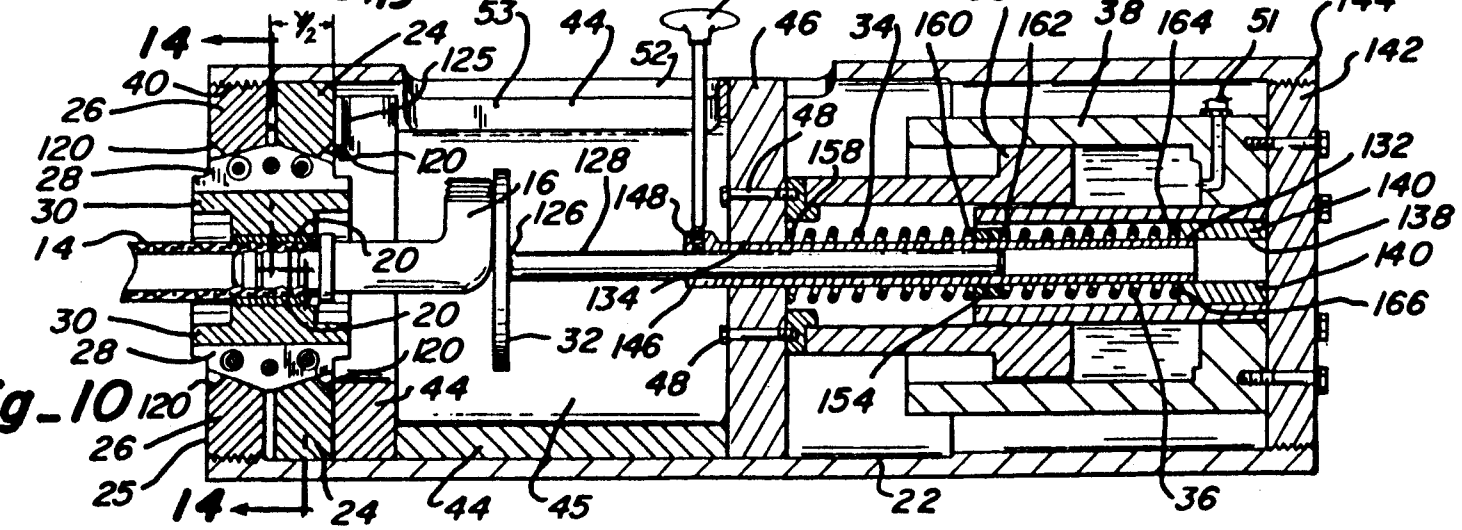
FIG. 10 is a cross-sectional view similar to FIG. 9 illustrating, however, the crimping apparatus in its crimping position.
Figure 11:
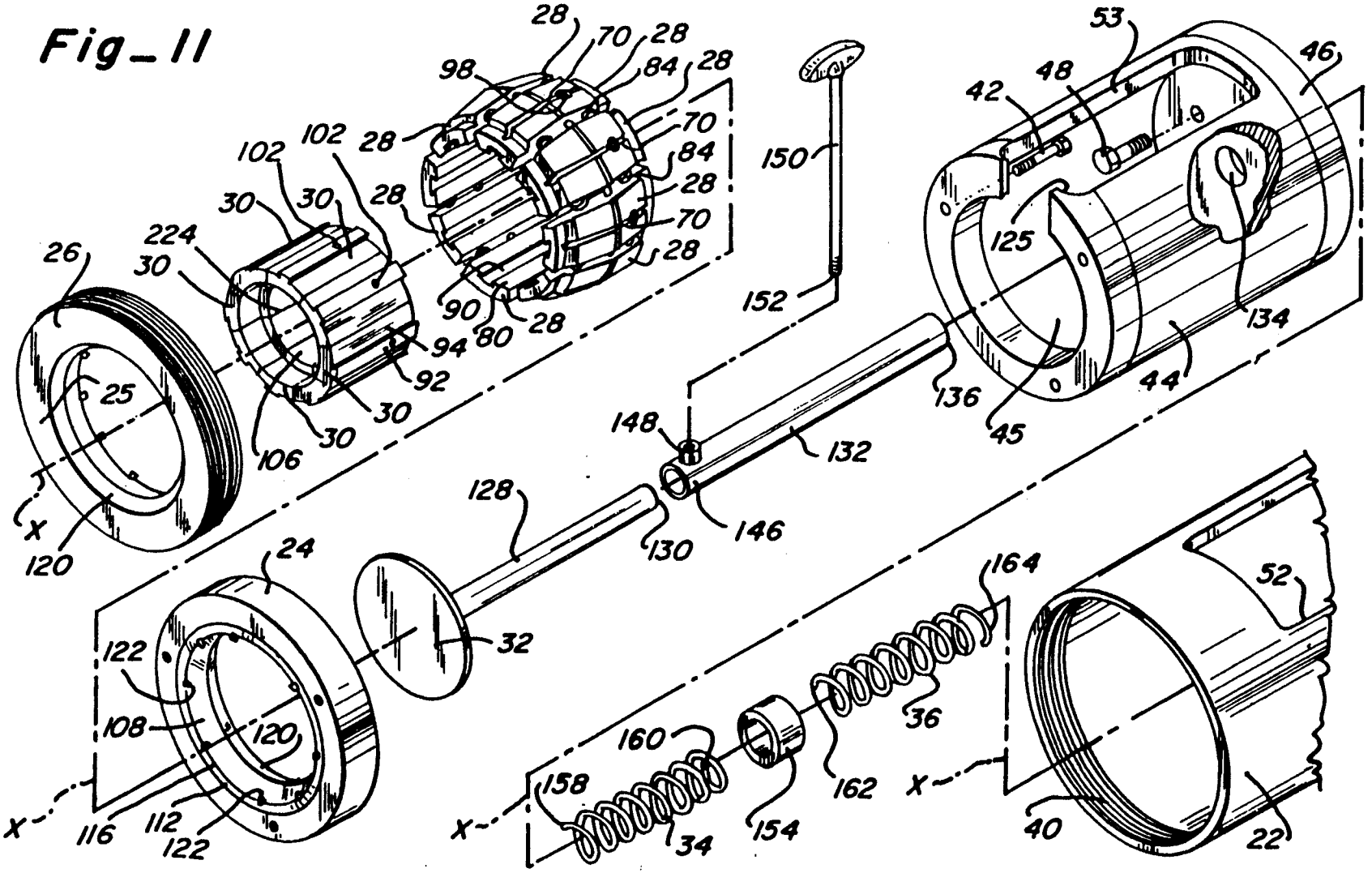
FIG. 11 is an exploded perspective view illustrating the major components of the crimping apparatus of the present invention.

Device 10 generally includes, as best illustrated in FIGS. 9-11, a cylindrical housing or base 22, a movable first or inner die cone or ring 24, a stationary second or outer die cone or ring 26, and eight circumjacently spaced and radially arranged, spring loaded crimping members including die shoes 28 and die fingers 30. Device 10 also generally includes a depth stop 32, first or front spring means 34 and second or back spring means 36, and a hydraulic cylinder actuating means 38.

Outer ring 26 is threadably secured to a threaded end 40 of housing 22 while movable ring 24 is rigidly secured by a bolt means 42 to a cylindrically shaped ram pusher 44. Ram pusher 44 defines a cylindrically shaped chamber 45 which is sized and configured to contain or accommodate most bent fittings. Ram pusher 44 also has a disc shaped, back plate centering means 46 which is rigidly secured by a bolt means 48 to a piston 50 of actuating means 38. Actuating means 38 is supplied with hydraulic fluid via a supply line 51 to drive piston 50 in a conventional manner which forms no part of this invention.

The top surfaces of housing 22 and ram pusher 44 also, respectively, define cutout portions 52 and 53 which enable the device to accommodate the free end of the bent portion of a long bent fitting. In addition, cutout portions 52 and 53 enable an operator to visually set and adjust depth stop 32, the procedure for which is described in detail below.

Figure 12:
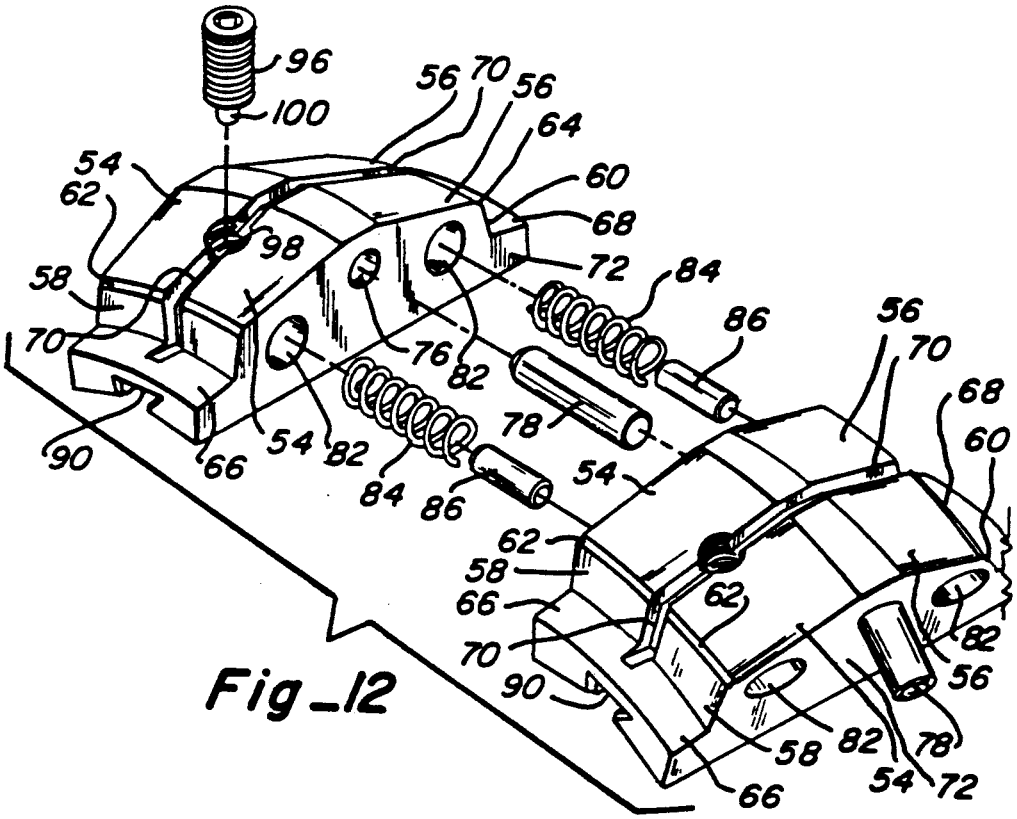
FIG. 12 is an exploded perspective view of two circumjacent die shoes of the present invention.

Each die shoe 28, as best illustrated in FIG. 12, defines first or inner and second or outer convex, force reactive gradually inclined or shallow surfaces 54 and 56, respectively, each of which is adjoined to first or inner and second or outer steep inclined convex, force reactive surfaces 58 and 60, respectively, by inner and outer inclined transition edges or surfaces 62 and 64, respectively. Each shoe also defines gradually inclined inner and outer ledges 66 and 68, respectively, which adjoin steep inclined surfaces 58 and 60, respectively. Shallow surfaces 54 and 56 and ledges 66 and 68 are preferably inclined at an angle of about 12° from the crimping axis of device 10 which is identified in FIG. 13 by the letter X. Steep inclined surfaces 58 and 60 are preferably inclined at an angle of about 82° from axis X with transaction edges 62 and 64 being inclined at an angle of about 47°. All of the aforementioned surfaces are also frustonconically shaped in that each defines a segment of a frustoconical surface which is formed when all of the dies are in contact and circumjacently arranged with respect to each other as illustrated, for example, in FIG. 14.

Each die shoe 28 also defines a groove 70 extending lengthwise from ledge 66 to ledge 68 across the center of the die shoe's inclined surfaces. The importance and operation of groove 70 will be described below.

Figure 13:
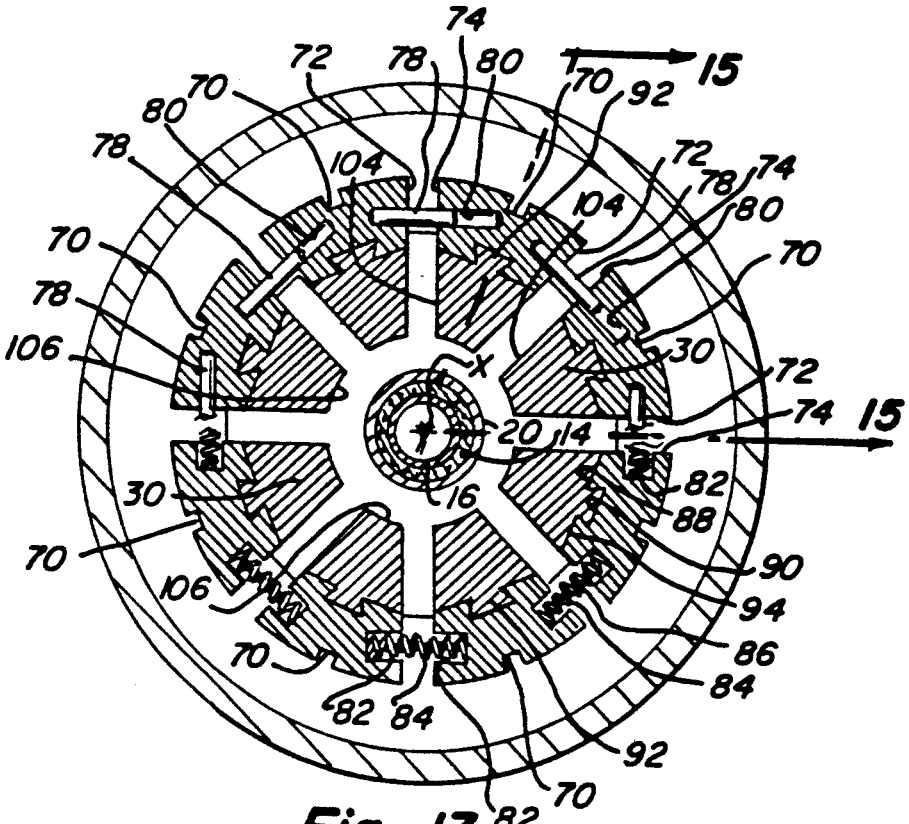
FIG. 13 is a cross-sectional view taken along the lines 13—13 of FIG. 9.
Figure 14:
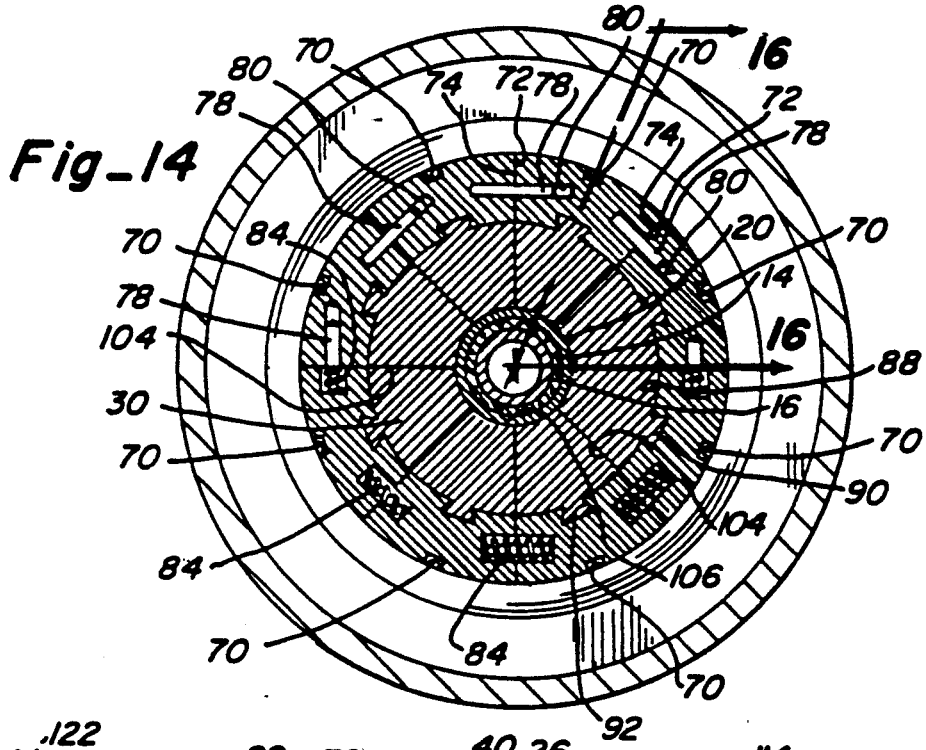
FIG. 14 is a cross-sectional view taken along the lines 14—14 of FIG. 10.

As best illustrated in FIGS. 13 and 14, each die shoe 28 also defines first and second sides 72 and 74, respectively, each of which is planar and angled so as to be aligned with a plane projecting radially from axis X.

In addition, each die shoe 28 defines a centrally located cylindrical bore 76 extending into the die shoe at a right angle as measured from side 72. Each bore 76 is sized to receive a complementary shaped, cylindrical pin 78 which is preferably rigidly attached to bore 76; for example, by threading or welding the pin to the bore. Each pin 78 projects outwardly at a right angle from side 72 and is provided with a length so that is also capable of extending into a cylindrical bore 80 provided in the circumjacent die it faces through the circumjacent die's side 74. Each bore 80 also extends inwardly into its respective die shoe at a right angle from its side 74. Moreover, each bore 80 must have a depth which enables it to slidably receive the full length of the portion of a pin 78 which projects outwardly from side 72 so that the die shoes can move radially inwardly to close as depicted in FIG. 14. Furthermore, to receive pin 78, each bore 80 must also be axially aligned with bore 76 of the circumjacent die shoe it faces.

While illustrated as being cylindrically shaped and centrally located on the sides of the die shoes, bore 76 and pins 78 may have any complementary shape and be located anywhere on the sides of the shoes as long as the selected shape and location permits the desired radial die movement.

Each die shoe 28 also defines two pairs of cylindrical bores 82, one pair of which is located symmetrically on opposite sides of bore 76 of side 72, the other pair being symmetrically located about bore 80 of side 74. Bores 82 extend into the die shoe at a right angle as measured from their respective sides and are sized to receive a coil spring 84 having a pin insert 86 located within the coil. As depicted in FIGS. 13 and 14, bores 82 of side 72 are axially aligned with those of side 74 of a circumjacent die shoe they face so that each facing or opposing pair of bores 82 can receive a coil spring 84 and pin insert 86.

Each die shoe further defines on an underside surface 88 thereof, a dove-tail shaped groove 90 which slidably receives a complementary shaped dove-tail projection 92 defined by a surface 94 of each die finger 30. Surfaces 88 and 94 are also complementary shaped as depicted in the Figures. The dove-tail grooves and projections slidably attach the die fingers to the die shoes.

Figure 15:
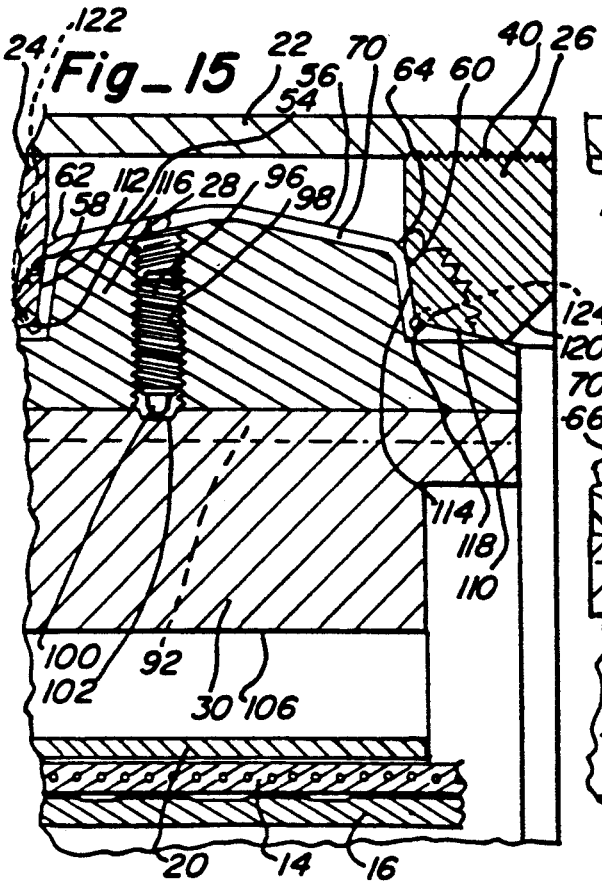
FIG. 15 is an enlarged partial cross-sectional view taken along lines 15—15 of FIG. 13.

Each die shoe 28 is also provided with a spring plunger means 96 which, as best depicted in FIG. 15, is threadably disposed in a threaded bore 98 of each die shoe. An end 100 of plunger 96 is spring loaded so as to impact up against and fit within a complementary shaped, selectively located detent 102 provided in surface 94 of each die finger 30. The insertation of end 100 in detent 102 prevents relative slidable movement between the die shoes and die fingers during the crimping stroke of device 10. However, the force exerted by plunger 96 can be easily overcome by an operator of device 10 who pushes the fingers in the direction of slidable attachment. Thus, an operator can easily remove die fingers 30 from the die shoes and insert other die fingers having a different crimping diameter, if such is desired.

Die fingers 30 also define sides 104 which are planar. Moreover, as with sides 72 and 74 of the die shoes, sides 104 are also angled so as to be aligned with a plane projecting radially from axis X. In addition, each die finger 30 defines a smooth and partially cylindrically shaped inner crimping surface 106. When crimping ferrule 20, surfaces 106 form a substantially cylindrical crimping surface about ferrule 20. While illustrated is being smooth, surfaces 106 could also be roughened (i.e., provided with indentations of some sort) to enhance crimping of the ferrule to the hose which may be desirable in some situations.

Inner and outer die rings 24 and 26 define force reactive, concave shallow or gradually inclined frustoconical surfaces 108 and 110, respectively, and force reactive concave steep inclined surfaces 112 and 114, respectively. The shallow and steep surfaces are adjoined by transition areas or surfaces 116 and 118, respectively. Surfaces 108 through 118 are sized and configured to complement inclined surfaces 54 through 64 of the die shoes so that the surfaces slide easily across each other. Accordingly, shallow surfaces 108 and 110 are also preferably inclined at an angle of 12° from axis X, steep inclined surfaces 112 and 114 at an angle of 82° and transition edges 116 and 118 at an angle of 47° from axis X. Each die ring, particularly outer die ring 26, is also preferably provided with a beveled edge 120 on the side of the ring opposite that defining the rings' steep inclined surfaces. The beveled edges, as illustrated, are inclined at an angle of about 45° from axis X and, as such, serve to facilitate insertion of a bent fitting between the die fingers.

Inner and outer rings 24 and 26 are also coaxial or axially aligned about axis X and oriented with respect to each other so that their respective steep inclined surface 112 and 114 face each other.

While the values set forth above for the various angles are preferred, the angles may be varied somewhat as may be necessary for a specific application. Generally, however, the steep surfaces will be angled between about 70° and 86° from ring axis X and the shallow surfaces between about 6° to 20° from ring axis X. Steep surfaces having an angle greater than about 86° will generally be too close to a right angle to initiate radial movement of the die shoes. Steep surfaces angled less than 70° and shallow surfaces less than 6° are also undesirable in that they will generally require a longer cylinder stroke. Shallow surfaces greater than 20° are also undesirable in that they will require the application of more crimping force from the hydraulic activating means.

FIGS. 9, 13 and 15 illustrate device 10 in its open loading position wherein springs 84 hold die shoes 28 and fingers 30 in their fully retracted position away from axis X. This position permits the insertion of a fitting such as bent fitting 16 between the die fingers. When in the open position, die shoes 28 are supported by inner and outer shallow surfaces 108 and 110 of the inner and outer rings, respectively, which supportingly contact the die shoes' inner and outer ledges 66 and 68, respectively. The die shoes' steep surfaces 58 and 60 will also generally be in contact with steep surfaces 112 and 114 of the inner and outer rings when the die shoes are in the open position.

Figure 16:
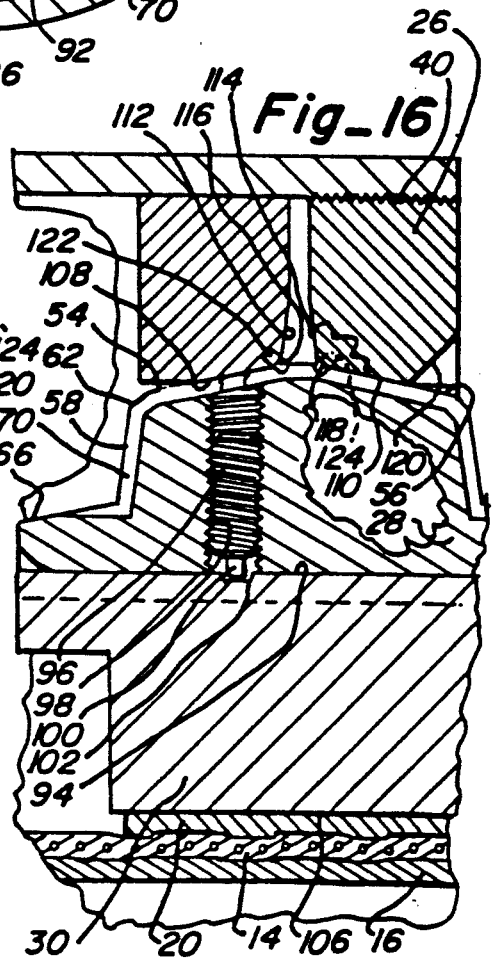
FIG. 16 is an enlarged, partial, cross-sectional view taken along lines 16—16 of FIG. 14.

FIGS. 10, 14 and 16 illustrate crimping device 10 in the crimping position wherein die shoes 28 and die fingers 30 have moved radially inward to crimp ferrule 20. In moving to this position from the open position illustrated in FIG. 9, it will be appreciated that movable inner die ring 24 attached to ram pusher 44 has been moved axially forward along axis X by the axial forward stroke of piston 50. This axial movement of die ring 24 towards outer die ring 26, in effect, pushes the die fingers and shoes radially inward. In so doing, the die shoes' ledges 66 and 68 at first lift off or separate from the die rings' respective shallow surfaces 108 and 110. The die shoes' steep surfaces 58 and 60 then slide, respectively, across the complementary shaped, steep surfaces 112 and 114 of the inner and outer die rings, respectively. This sliding engagement continues until transition edges 62 and 64 of the die shoes contact transition edges 116 and 118 of the inner and outer rings, respectively. The transition edges then slide, respectively, across each other until the respective shallow surfaces 54 and 56 of the die shoes contact the shallow surfaces 108 and 110 of the die rings, respectively. Further movement of inner die ring 24 towards outer die ring 26 causes the shallow surfaces of the die shoes and rings to slide across each other, thereby pushing the die shoes and fingers radially inward to crimp the ferrule.

To return die shoes 28 and die fingers 30 to the open position to enable removal of hose assembly 12 after ferrule 20 has been crimped, piston 50 is activated to initiate the device's return stroke which moves inner ring 24 axially away from outer ring 26. This action allows springs 84 located between each circumjacent die shoe to recoil, thereby separating the die shoes and causing the die shoes' and rings' respective inclined surfaces to slide back across each other until the die shoes and fingers are back in the open position. Pin inserts 86 which are located within the coil springs are of help in keeping the coil springs properly aligned and maintained within bores 82 of the dies shoes, thereby preventing damage to the springs during crimping and during assembly of the machine. They are also believed to be of help in maintaining the die shoes in alignment during crimping.

An important aspect of the present invention is directed to maintaining die shoes 28, and thus, die fingers 30, in alignment during crimping as the shoes and fingers move radially between the open and crimping positions. Maintaining such alignment is particularly difficult when the respective transition surfaces of the die shoes and die rings are sliding across each other. If, for example, the inner transition surfaces of a die shoe and die ring slide across each other slightly ahead of the outer transition surfaces, the outer transition surfaces may slip off of outer die ring 26 (i.e., outwardly away from axis X) which, in turn, will cause the inner transition surfaces to slip off inner die ring 24 (i.e., inwardly towards axis X), thereby tipping the die shoe. Such tipping is undesirable because it often causes other dies to tip, thereby jamming the entire device.

Figure 1:
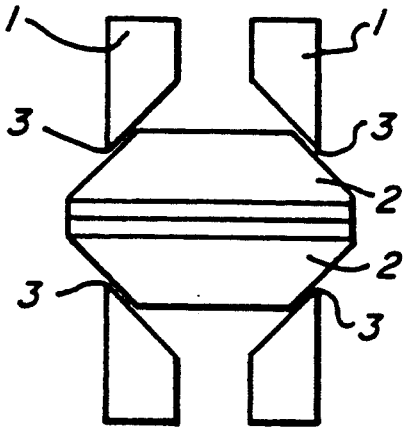
Fig 1 PRIOR ART
FIG. 1 is a cross-sectional view of the crimping head of a prior art single angle, double ring crimping apparatus which illustrates the crimping head in its closed or crimping position.
Figure 2:
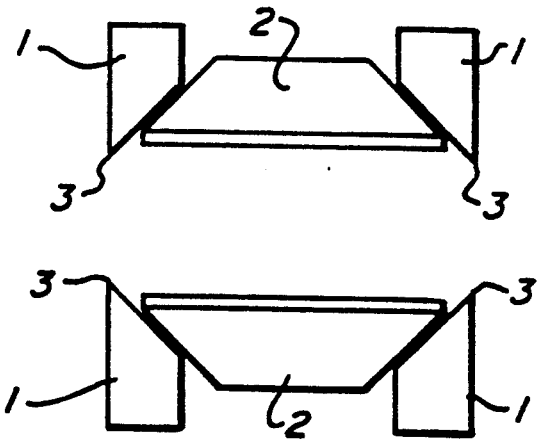
Fig 2 PRIOR ART
FIG. 2 is a cross-sectional view of the prior art crimping apparatus illustrated in FIG. 1 showing the crimping head in its open position.
Figure 3:
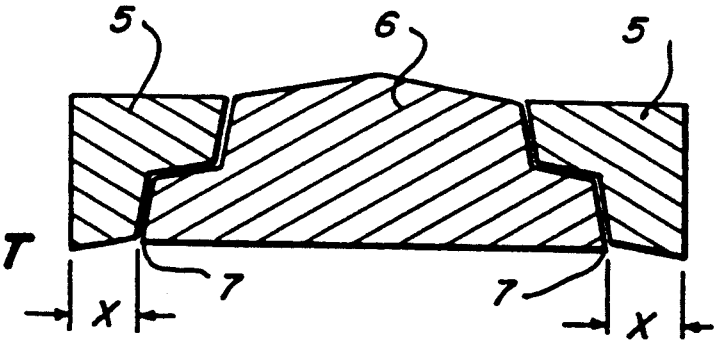
Fig 3 PRIOR ART
FIG. 3 is a partial, cross-sectional view of the crimping head of a double cone, double angle crimping apparatus illustrating a die and the rings of the crimping head in the open position.
Figure 4:
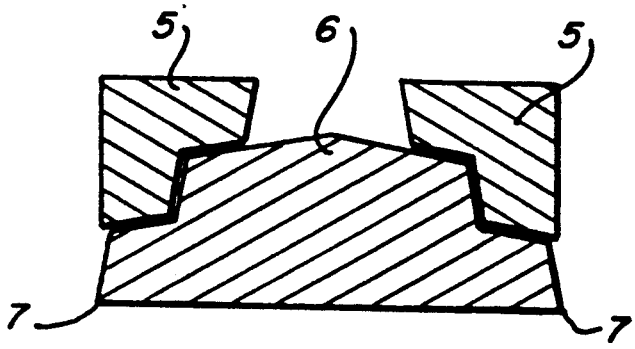
Fig 4 PRIOR ART
FIG. 4 is a partial, cross-sectional view illustrating the crimping head components of FIG. 3 in the closed die or crimping position.
Figure 5:
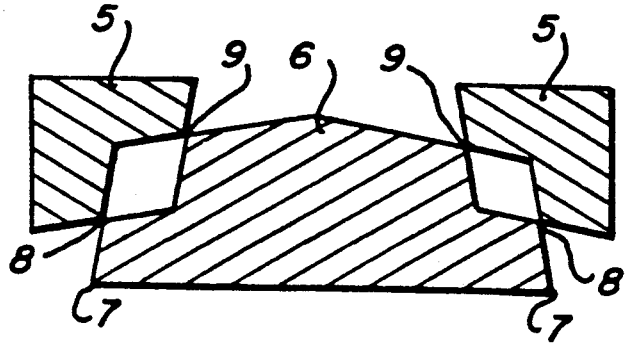
Fig 5 PRIOR ART
FIG. 5 is a partial, cross-sectional view of the components illustrated in FIGS. 3 and 4 showing the components at a position intermediate the open and crimping positions.

The die shoes of conventional double step, double ring crimping devices such as that illustrated in FIGS. 3 through 5 are prevented from tipping because, as illustrated in FIG. 5, each die shoe, (i.e., die shoes 7 of FIG. 5) slides through two transition areas (identified in FIG. 5 by numerals 8 and 9) which are provided on each die ring. The use of two transition areas prevents tipping because the transition areas apparently act as braces to support each other as they slide across each other. While this is advantageous, the large width of a double step die ring is, as previously mentioned, objectional because it increases the distance a fitting has to be inserted between the dies, thereby lengthening the crimping head which makes it much more difficult to insert bent fittings.

Pins 78 solved the aforementioned tipping problem confronting die shoes 28 because they apparently prevent the die shoes from rotating relative to each other; that is, as long as each pin 78 remains at least partially disposed within its associated bore 80 of the circumjacent die shoe it faces.

To further enhance alignment of the die shoes and fingers, device 10 is also preferably provided with means for preventing rotational movement of the die shoes as a unit with respect to the die rings. The means for preventing such in device 10 includes a pair of inner and outer tines 122 and 124 for each die shoe, which, respectively, project outwardly from transition edges 116 and 118 of inner and outer rings 24 and 26. Tines 122 and 124 are sized and configured to slide within grooves 70 of the die shoes as the shoes move radially between the open and crimping die positions. This slidable engagement of the tines and grooves is best illustrated in FIGS. 15 and 16 wherein it can be visualized that a pair of tines 122 and 124 slides within a groove 70 of a die shoe as the rings move the die shoes.

While eight pairs of inner and outer tines are illustrated in the figures, fewer pairs (i.e., possibly four pairs) may also prevent rotational movement of the die shoes as a unit with respect to the die rings. Moreover, while device 10 employs tines and grooves to prevent such rotational movement, other means for preventing such movement are considered to be within the scope of the present invention. For example, instead of a groove 70, each die shoe 28 could be provided with a longitudinally extending ridge which would slidably engage with a pair of grooves extending across the transition edges of the inner and outer die rings.

Inasmuch as the aforementioned pins 78 and tines and grooves 122 and 124, respectively, maintain die shoes 28 in alignment and prevent their tipping during crimping (i.e., during radial movement of the dies shoes) it will be appreciated that the need for die rings having two transition areas for supporting the dies shoes during crimping is obviated. Accordingly, relatively thin die rings such as die rings 24 and 26 having only one transition area (defined by a single pair of steep and shallow concave frustoconical surfaces) can be employed. This is advantageous, as previously alluded to, because it shortens the crimping head thereby making it easier to insert bent fittings through the opening defined by the open die fingers.

Device 10 has an extremely short crimping head as characterized by its axial crimping head length to radial die movement ratio which is only 8:1. This is significantly less than the 12.8:1 ratio, previously described above in the background section for the Saudr Type 88 press. Device 10 can also accommodate hose having an inside diameter of two inches whereas, the Saudr type 88 crimper can only accommodate 1½ inch ID hose.

Preferred axial crimping head length to radial die movement ratios in accordance with the present invention, will be less than 12.8:1 with ratios between about 6:1 and 9:1 providing extremely good results. The 8:1 ratio of device 10 was determined by dividing the axial length of the crimping head in it open position by the radial distance travelled by a die finger 30 during a crimping stroke of device 10. The axial length of the crimping head of device 10 in its open position is 6 inches which is the axial distance between the outer facing surface 25 of outer ring 26 and inner facing surface 125 of ram pusher 44. The radial distance travelled by a die finger of device 10 during a crimping stroke is 0.75 inches.

It will be appreciated from FIGS. 9 and 10 that the die shoes and fingers not only move radially as they move between the open and crimping positions but also axially a distance equal to ½ Y. They move only one half the axial distance moved by inner ring 24 and at half ring 24's axial speed because they are constrained to remain centered between the inner and outer rings as such movement takes place. Since the depth stop moves at the same axial speed as inner ring 24, it also moves at twice the die shoes' and fingers' axial speed, thereby making it difficult to set the depth stop so that the die fingers crimp only the ferrule, which problem is discussed above in the background section of the invention.

The present invention solves the problem of setting or positioning the ferrule by providing means for reducing the axial speed of depth stop 32 so that it travels axially forward at the same rate that the die shoes and fingers travel axially forward. Accordingly, ferrule 20 can be precisely crimped, as desired, by simply maintaining bent fitting 16 up against the depth stop during the crimping stroke of device 10. One only needs to properly adjust the depth or axial position of the depth stop which is quite simple with device 10, as will be explained below.

Depth stop 32, as best illustrated in FIGS. 9–11, is generally disk shaped and attached at its center to a proximal end 126 of a cylindrical rod or stem 128. A distal end 130 of stem 128 is slidably received and in telescoping engagement with a cylindrical centering tube 132. Centering tube 132 is slidingly received by an axially aligned cylindrical bore 134 defined by back plate centering means 46. A distal end 136 of centering tube 132 is also slidably received in a cylindrical, axially aligned bore 138 defined by a stationary depth stop spacer 140. Depth stop spacer 140 is positioned against and supported by a disc-shaped back plate 142 of device 10 which, in turn, is threadably secured to an end 144 of cylindrical housing 22.

The other end of centering tube 132 identified by numeral 146 in FIG. 11 is provided with an integral threaded extension 148 which threadably engages with a depth stop adjusting handle 150 having an end 152. Tightening handle 150 will cause end 152 to impact against stem 128 thereby tightly securing stem 128 and centering tube 132 together. Accordingly, it will be appreciated that by untightening handle 150, stem 128 can be telescopingly moved within tube 132, thereby enabling one to adjust the depth or axial position of depth stop 32.

Returning to FIGS. 9 and 10, it can be seen that a cylindrical collar 154 is mounted on and attached by a set screw 156 to centering tube 132 at a point along the centering tube's midsection. It can also be seen that front and back springs 34 and 36 are mounted on or located over centering tube 132 on opposite sides of collar 154 so that a first end 158 of front spring 34 is located against centering plate 46 of the ram pusher and a second end 160 of spring 34 located against collar 154. The other side of collar 154 has a first end 162 of back spring 36 located against it and a second end 164 of back spring 36 located against an end surface 166 of depth stop spacer 140.

As previously mentioned, FIG. 9 illustrates device 10 in the open position and FIG. 10 illustrates the crimping position. Accordingly, when comparing coil springs 34 and 36 in FIGS. 9 and 10, it will be recognized that in moving from the open position to the crimping position coil springs 34 and 36 have recoiled a certain extent. By so recoiling, the coil springs reduce the forward axial speed of the depth stop relative to the forward axial stroke of piston 50 which moves die ring 24. If springs 34 and 36 are of equal strength and collar 154 is located on centering tube 132 such that both springs exert an equal force on it (which generally means that collar 154 will be located equidistant between the springs) the forward axial speed of depth stop 32 will be exactly ½ that of inner die ring 24. Accordingly, the depth stop will move axially forward with the die shoes and die fingers and at the same rate. Thus, the depth stop and die fingers relative positions will remain unchanged as device 10 makes its crimping stroke.

Thus, to precisely crimp a ferrule, as desired, with the depth stop speed reducing means of the present invention, one only has to do the following:

1. insert hose assembly 12 between the die fingers;
2. position the hose assmembly between the die fingers so that the ferrule will be crimped at the desired position. Generally, this only requires that the end of the ferrule be aligned or flush with an inner end of a die finger;
3. position the depth stop up against the fitting of the hose assembly;
4. tighten the depth stop handle 150 so that the depth stop maintains its position relative to the die fingers as the die fingers are moved from the open to the crimping position; and
5. maintain or hold the fitting up against the depth stop until the die fingers begin crimping the ferrule.

FIGS. 17 through 21 illustrate an apparatus for slidably loading a complete set of circumjacent, radially arranged die fingers 30 as a unit into die shoes 28 of device 10. The apparatus generally includes a cylindrically shaped container 200 and a plunger 202.

Container 200 has an open top end 204 and a the partially open bottom end 206, partially opened bottom end being defined by an integral annular lip or die finger restraining means 208 which circumferentially extends around the bottom of the container to prevent the die fingers from falling through the bottom end 206. Container 200 is also provided with an inside diameter which enables the set of die fingers 30 to be slidably loaded into the container through its open top end 204. The inside diameter of the container should preferably be slightly larger than the outside diameter of the set of radially arranged die fingers so that the set of fingers will fit relatively snug within the container yet loose enough so that they can be slid out of the container. The container is also preferably provided with a cylindrical length or height which is slightly less than the length of the die fingers it is designed to hold. This will expose the ends of the die fingers dove-tail attaching projections 92 which will help an individual properly align the fingers with shoes 28 of device 10 when it is desired to load the die fingers into device 10, as will be explained in more detail below.

Plunger 202 has a cylindrical shaft or stem 210 having a length which is preferably greater than twice the height of container 200. Stem 210 is also provided with a handle 212 covering one end of the stem and a disc shaped push-pull means 214 attached to the stem's other end. Push-pull means 214 is sized and configured to pass through both open top and bottom ends 204 and 206, respectively.

To load device 10 with a set of circumjacent, radially arranged die fingers 30, one first removes or lifts container 200 containing a set of die fingers 30 out of a holder 216 (see FIG. 6) provided in device 10. Container 200 is then placed against the outwardly facing ends 218 of die shoes 28 which, as illustrated, protrude slightly from device 10 as depicted in FIG. 17. As illustrated, the die shoes as also in their closed or crimping position. Following this, container 200 is axially aligned with axis X of device 10 and then rotated about axis X until the die fingers' and die shoes' respective dove-tail shaped projections and grooves 92 and 90 align with each other. Push-pull means 214 of plunger 202 is then located up against the outer facing ends 220 of die fingers 30 by inserting push-pull means 214 through bottom end 206 of the container. Plunger 202 is then pushed inwardly towards device 10 which causes the die fingers to slide out of container 200 into the die shoes on their respective dove-tail shaped projections and grooves 92 and 90. The fingers are pushed into the shoes until they are slidably locked together by spring plunger means 96, which, as previously described, prevents the fingers and shoes from relative slidable movement with respect to each other by spring loading itself within detent 102 provided in each die finger. A stop means may also be provided in dovetail groove 90 to prevent the die fingers from being pushed through the die shoes.

To remove die fingers 30 from die shoes 28, one positions plunger 202 as such is depicted in FIG. 19 with push-pull means 214 located up against the fingers' inner facing ends 222 and with stem 210 extending axially through an opening 224 defined by fingers 30 when they are in the closed or crimping position. As such, handle 212 of the plunger will project outwardly through opening 224.

To position plunger 202 as depicted in FIG. 19, the free end of handle 212 is inserted through cutout portions 52 and 53 of housing 22 and ram pusher 44, respectively, and then through opening 224 defined by fingers 30. It may be necessary, sometimes to move the die fingers and shoes to their open position in order to insert handle 212 through opening 224. After doing so, the die fingers and shoes should be moved to the closed or crimping position. Container 200 is then positioned over handle 212. The container's open top end 204 is then located over the outwardly facing ends 218 of the die shoes. This locates the container axially about axis X so that an operator is capable of removing fingers 30 from die shoes 28 by merely pulling on handle 212 which causes each spring plunger means 96 to recoil and thereby permit fingers 30 to slide out of die shoes 28 and into container 200. Container 200, now loaded with die fingers 30, may be returned and stored in holder 16 of device 10. If desired, another set of die fingers may now be loaded into dies shoes 28.

This invention has been described in detail with reference to particular embodiments thereof, but it will be understood that various other modifications can be effected within the spirit and scope of this invention.

We claim:

1. An apparatus for slidably loading a plurality of circumjacent, radially arranged crimping members into crimping member holders of a crimping device, the holders being radially arranged about an axis of the crimping device, the apparatus comprising:

a container for slidably receiving and holding the plurality of circumjacent, radially arranged crimping members, the container having an open top and through which the plurality of crimping members passes when being loaded into the crimping device, the container also having an open bottom end with restraining means attached thereto for preventing the plurality of crimping members from passing through the bottom end; and a plunger having a stem-like handle and push-pull means attached to an end of the handle, the push-pull means being sized and configured to pass through the bottom end to push the circumjacent, radially arranged crimping members out through the container's top end and slidably load the crimping members into the holders.

2. An apparatus as claimed in claim 1 wherein the restraining means includes an annular lip projecting radially inwardly.

3. An apparatus as claimed in claim 1 wherein the push-pull means is disc shaped.

4. An apparatus as claimed in claim 1 wherein the stem has a length which is greater than about twice the length of the container.

5. An apparatus as claimed in claim 2 wherein the annular lip is integral with the container.

6. A method of slidably loading a plurality of circumjacent, radially arranged crimping members into crimping member holders of a crimping apparatus, the holders being radially arranged about a crimping axis of the crimping apparatus, the method comprising the steps of:

containing the plurality of crimping members so that the crimping members are capable of being slidably loaded into the holders;

axially aligning the plurality of contained crimping members with the crimping axis of the crimping apparatus;

positioning the axially aligned and contained crimping members up against the holders; and pushing the positioned axially aligned and contained crimping members axially towards the holders to slide the crimping members onto the holders, thereby loading the crimping head with the crimping members.

7. A method as claimed in claim 6 further comprising the steps of:

providing the crimping members and crimping member holders with complementary shaped slidable attaching means so as to secure the crimping members to the holders when the respective slidable attaching means are in slidable engagement with each other; and rotating the axially aligned crimping members so that the complimentary shaped slidable attaching means of the crimping members and holders are aligned with each other prior to pushing the crimping members axially into the holders.

8. A method as claimed in claim 6 further comprising the steps of:

axially aligning an empty cylindrically shaped die holding container with the axis of the crimping apparatus;

positioning the container up against a head of the crimping apparatus; and pulling the crimping members out of the crimping member holders into the axially aligned container which is positioned against the head of the crimping apparatus.

9. A method as claimed in claim 8 further comprising: storing the container holding the crimping members.

10. In a combination of a crimping apparatus and a loading and unloading apparatus for die fingers and of the type with first and second crimping rings that are arranged coaxially with and axially spaced apart from each other along the ring axis, the rings having facing frustoconical surfaces that engage oppositely facing frustoconical surfaces of crimping members that each include a die shoe connected to a die finger, and where the crimping members are interpositioned between the rings and arranged substantially circumjacently around the ring axis and where one ring is reciprocally moveable along the ring axis and effects a radial component of movement of the crimping members, and wherein the improvement comprises:

each die shoe having an underside surface facing radially inwardly and oriented in the direction of the ring axis;

each die finger having a surface facing radially outwardly and oriented in a direction of the ring axis, the so facing surfaces each having substantially complementary portions that together define a means for slideably attaching and slideably detaching each die finger to and from each die shoe in a direction of the ring axis; and said loading and unloading apparatus including means for simultaneously slideably loading the die fingers on the die shoes and simultaneously slideably unloading the die fingers from the die shoes and wherein said means comprises:

a substantially cylindrically shaped container having an inside diameter that is open at a top end and partially closed at a bottom end with an integral annular lip, the container having an inside diameter sufficiently large enough to receive the circumjacently spaced die fingers, and having a length that is less than a length of each die finger; and a means for 1) pushing the die fingers from the container and slideably attaching them to the die shoes and 2) pulling the die fingers and slideably deattaching them from the die shoes and into the container.

11. The crimping apparatus as claimed in claim 10 wherein the pushing and pulling means comprises a shaft with an end connected to a disc that has a diameter less than the diameter of the integral lip.

* * * * *

UNITED STATES PATENT AND TRADEMARK OFFICE

CERTIFICATE OF CORRECTION

PATENT NO. : 5,243,846

DATED : Sept. 14, 1993

INVENTOR(S) : Edward H. Davis; Gerard F. Klaes

It is certified that error appears in the above-identified patent and that said Letters Patent is hereby corrected as shown below:

On the title page, item (75), inventors, "Gerald F. Klaes" should read--Gerard F. Klaes--.

Signed and Sealed this

Fifth Day of April, 1994

Bruce Lehman

*Attest:*

BRUCE LEHMAN

*Attesting Officer*

*Commissioner of Patents and Trademarks*